US005423969A

United States Patent [19]

Masumoto et al.

[11] Patent Number: 5,423,969

[45] Date of Patent: Jun. 13, 1995

[54] SACRIFICIAL ELECTRODE MATERIAL FOR CORROSION PREVENTION

[75] Inventors: Tsuyoshi Masumoto; Akihisa Inoue; Takashi Sakuma; Toshisuke Shibata, all of Sendai, Japan

[73] Assignee: YKK Corporation, Tokyo, Japan

[21] Appl. No.: 217,009

[22] Filed: Mar. 23, 1994

Related U.S. Application Data

[63] Continuation of Ser. No. 847,717, Mar. 6, 1992, abandoned.

[30] Foreign Application Priority Data

Mar. 7, 1991 [JP] Japan ..... 3-065321

[51] Int. Cl.[6] ..... C25B 11/04

[52] U.S. Cl. ..... 204/293; 204/196

[58] Field of Search ..... 204/196, 280, 293; 420/402, 407, 408, 405

[56] References Cited

U.S. PATENT DOCUMENTS

| | | | |
|---|---|---|---|
| 2,459,123 | 1/1949 | Bates et al. | 204/293 |
| 5,087,304 | 2/1992 | Chang et al. | 420/405 |
| 5,147,603 | 9/1992 | Nussbaum et al. | 420/407 |
| 5,250,124 | 10/1993 | Yamaguchi et al. | 420/405 |
| 5,304,260 | 4/1994 | Aikawa et al. | 420/407 |

FOREIGN PATENT DOCUMENTS

| | | |
|---|---|---|
| 0361136 | 4/1990 | European Pat. Off. . |
| 0461633 | 12/1991 | European Pat. Off. . |

OTHER PUBLICATIONS

Masumoto, et al.; "Amorphous Kinzoku no Kiso", 1985 by Ohm-sha, pp. 1-5, Translation only 1-2. ** No date available.

Binran; "History of Research and Development of Amorphous Metal Materials", 1986; pp. 235-237, Translation Only pp. 1-2. ** No date available.

Patent Abstracts of Japan, vol. 009, No. 254 (C-308) Oct. 11, 1985 and JP-A-60 106 980 (Furukawa Denki Kogyo KK), Jun. 12, 1985 Abstract.

Patent Abstracts of Japan, vol. 011, No. 282 (C-446) Sep. 11, 1987 and JP-A-62 080 287 (Mitsubishi Alum. Co. Ltd., Apr. 13, 1987 Abstract.

*Primary Examiner*—Kathryn Gorgos

*Attorney, Agent, or Firm*—Flynn, Thiel, Boutell & Tanis

[57] ABSTRACT

The present invention provides a sacrificial electrode material which consists of a single phase amorphous structure or a structure consisting of an amorphous phase and a crystalline solid solution phase and provides electrochemical corrosion protection to metallic articles exposed to an aqueous electrolytic solution. The electrode material is prepared by rapidly quenching a magnesium-based alloy material from the liquid phase or vapor phase thereof, the magnesium-based alloy material consisting the general formula: $Mg_{bal}X1_aX2_b$ or $Mg_{bal}X1_a$, wherein X1 is at least one element selected from the group consisting of Al, Zn, Ga, Ca and In; X2 is at least one element selected from the group consisting of Mm (misch metal), Y and rare earth metal elements; a and b are, in atomic percentages, $5.0 \leqq a \leqq 35.0$ and $3.0 \leqq b \leqq 25.0$, respectively. The magnesium-based alloy material may further contain one or more transition metal elements in their total contents not exceeding 1.0 atomic %.

6 Claims, 1 Drawing Sheet

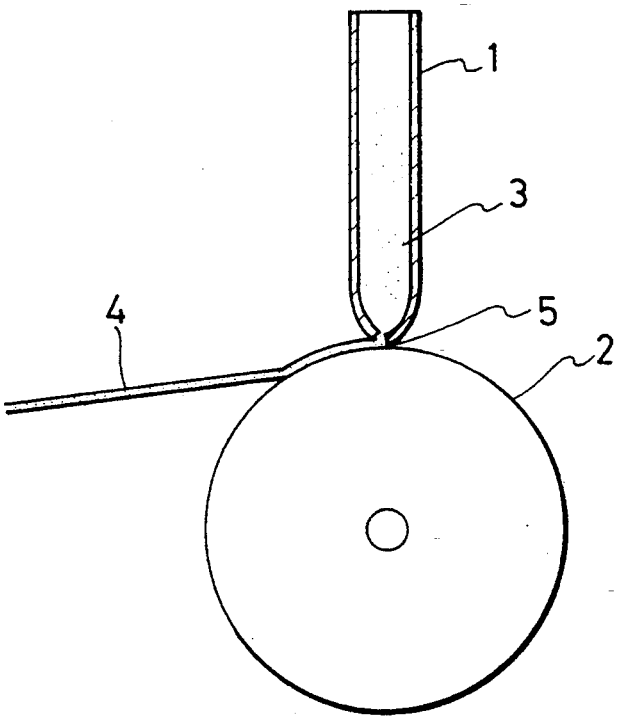
1
3
4
5
2

SACRIFICIAL ELECTRODE MATERIAL FOR CORROSION PREVENTION

This application is a continuation of U.S. Ser. No. 07/847 717, filed Mar. 6, 1992, now abandoned.

BACKGROUND OF THE INVENTION

1. Field of the Invention

The present invention relates to a sacrificial electrode material consisting of an magnesium-based alloy and providing electrochemical corrosion protection to metallic articles exposed to an aqueous electrolytic solution, such as copper condensate tubes or iron tubes used in heat exchangers or the like which are exposed to sea water or other similar environments.

2. Description of the Prior Art

In general, electrochemical corrosion-prevention methods using magnesium-based alloys or zinc-based alloys as anodes have been employed for the purpose of protecting structural parts or members of heat exchangers or the like from corrosion.

Particularly, since anode materials made of magnesium or magnesium-based alloys are electrochemically base relative to the structural materials of copper alloys or iron alloys used in heat exchangers, they have been expected to be suitable as sacrificial anode materials for corrosion prevention. Despite this advantageous property, the conventional magnesium-based alloy materials have not yet been widely used as sacrificial electrode materials.

The reason for this is considered to as follows. As the magnesium-based alloy sacrificial electrode materials, Mg—Al—Zn alloys have been used, but they are useful within the content ranges of Al and Zn of less than 7 atomic % and less than 4 atomic %, respectively. When the contents of Al and Zn in the alloys exceed these content ranges, the resulting alloys have a significantly noble spontaneous electrode potential and are unsuitable for use as sacrificial electrodes.

Further, in the above Mg—Al—Zn alloy sacrificial electrode materials, transition metal elements, such as iron, nickel, copper, etc., are controlled to 30 ppm or less in their total. When these elements are present as impurities or alloying elements in the alloys, the self-corrosion resistance of the materials considerably reduces and the useful life as sacrificial electrodes becomes short.

Conventional materials obtained by casting or by subsequent rolling are composed of coarse crystal grains. Therefore, when such conventional materials are employed as sacrificial electrode materials, corrosion selectively proceeds along crystal grain boundaries, and, thereby, separation and breakage of the materials occur. Consequently, the useful life as sacrificial anodes significantly reduces. Especially, when the above-mentioned transition metal elements coexist as solute elements or impurities, the above-mentioned tendency is considerable. Therefore, the contents of the transition metal elements have been very strictly limited.

For the foregoing reason, the use of the conventional magnesium-based alloy materials as sacrificial electorodes has been limited to a narrow range, although they are electrochemically base as compared with aluminum-based alloys or zinc-based alloys.

SUMMARY OF THE INVENTION

In view of the foregoing, an object of the present invention is to eliminate the aforesaid separation or destruction problems induced by the presence of coarse crystal grains and selective corrosion along grain boundaries (intergranular corrosion) and thereby provide an improved useful life. A further object of the present invention is to provide a sacrificial electrode material having a superior corrosion-preventing effect together with a superior self-corrosion resistance in which transition metal elements may be present not only as unavoidable impurities but also as purposeful additives to improve the mechanical properties of the sacrificial electrode material.

The present invention provides a sacrificial electrode material consisting of a single phase amorphous structure free of crystal grain boundary or a composite phase structure consisting of an amorphous phase and a crystalline solid-solution phase. The sacrificial electrode material can be obtained in the form of thin films, thin ribbons, fine wires or particles or bulk shapes by rapidly quenching an magnesium-based alloy material from the liquid phase or vapor phase. For example, such a sacrificial electrode material can be obtained by rapidly quenching a molten magnesium-based alloy material with a specific composition at a cooling rate of $10^2$ to $10^6$ K/second, employing liquid quenching methods. As the magnesium-based alloy material used in the present invention, there may be mentioned a magnesium-based alloy material consisting of a composition represented by the general formula:

$$Mg_{bal}X1_aX2_b \text{ or } Mg_{bal}X1_a,$$

wherein:

X1 is at least one element selected from the group consisting of Al, Zn, Ga, Ca and In;

X2 is at least one element selected from the group consisting of Mm (misch metal), Y and rare earth metal elements;

a and b are, in atomic percentages:

$$5.0 \pm a \pm 35.0 \text{ and } 3.0 \pm b \pm 25.0,$$

respectively.

The magnesium-based alloy material may further contain at most 1.0 atomic % in total of one or more transition metal elements.

In the thus obtained electrode materials, solute metal elements are uniformly dispersed throughout the electrode material so that precipitation of various intermetallic compounds formed among the solute metal elements, impurities comprising the transition metal elements as mentioned above and a matrix metal element, is prevented and formation of local cells in the material is also prevented. Further, the tendency of the sacrificial electrode material to be more noble in comparison with the spontaneous electrode potential value (measured using a saturated calomel electrode as a standard electrode) of pure magnesium, which tendency becomes considerable with an increase in the content of the solute elements, is minimized. As a result, the sacrificial electrode material is significantly improved in its current efficiency and useful life.

Further, according to the present invention, since corrosion of the sacrificial electrode uniformly proceeds, the corroded face of the electrode is smooth and the separation or breakage of the electrode can be prevented.

BRIEF DESCRIPTION OF THE DRAWING

The single figure shows a schematic view illustrating an embodiment of the production of materials according to the present invention.

DETAILED DESCRIPTION OF THE PREFERRED EMBODIMENTS

In detail, the present invention provides a superior sacrificial electrode material having an electrochemically base spontaneous electrode potential together with a superior corrosion resistance, which consists of a matrix of magnesium and a first additive element X1 of at least one selected from the group consisting of Al, Zn, Ga, Ca and In in a content of 5.0 to 35.0 atomic %, and, optionally, a second additive element X2 of at least one selected from the group consisting of Mm (misch metal), Y and rare earth elements in a content of 3.0 to 25.0 atomic %. The sacrificial electrode material can contain impurities comprising transition metal elements in a total content of not more than 1.0 atomic %.

The addition of the element X1 to magnesium prevents the spontaneous electrode potential of the electrode material from being more noble and effectively improves the self-corrosion resistance. The element X2 is effective in providing a more base spontaneous electrode potential to the material. Further, the element X2 suppresses the diffusion of the element X1 and the impurities comprising transition metal elements into the magnesium matrix and ensures the quenching effect by which precipitation of intermetallic compounds is inhibited and an amorphous structure or a uniform solid solution is formed.

The content of the element X1 should be in the range of 5.0 to 35.0 atomic %. When the content is less than 5.0 atomic %, the self-corrosion resistance deteriorates. On the other hand, when the content exceeds 35.0 atomic %, the spontaneous electrode potential becomes noble. Therefore, the properties required for sacrificial electrodes can not be obtained in either case. The content of the element X2 is limited to the range of 3.0 to 25.0 atomic %. When the content is less than 3.0 atomic %, the quenching effect is not adequate. When the content exceeds 25.0 atomic %, the self-corrosion resistance deteriorates and the desired properties can not be obtained. Further, the maximum tolerable level of the impurities comprising transition metal elements is 1.0 atomic %. When the impurity content exceeds 1.0 atomic %, such excessive impurities can no longer dissolve in the state of solid solution in the matrix through the production process used in the present invention and precipitate individually or as intermetallic compounds.

The reason why the structure of the material of the present invention is composed of an amorphous phase or a composite phase consisting of an amorphous phase and a crystalline solid solution phase is as follows. It is known that an amorphous phase is free of crystal grain boundary and solute elements uniformly dissolve in the state of solid solution. Therefore, when an anode is prepared from such an amorphous structure, dissolution of the anode occurring during the reaction on the anodes uniformly proceeds and optimum properties as a corrosion-preventing electrode can be obtained. On the other hand, in the composite phase consisting of an amorphous phase and a crystalline phase, grain boundaries between the amorphous phase and the crystalline phase or between the crystalline phases are not still unclear and, at this stage, precipitates of intermetallic compounds and so forth are not detected. Therefore, in such unclear grain boundaries, selective corrosion, which may bring about problems in the sacrificial electrodes for corrosion prevention, was not detected and almost the same effects as in the amorphous single phase structure can be obtained. However, when crystallization proceeds and the composite phase is completely transformed into a stable crystalline structure in which there is no amorphous phase, precipitates of intermetallic compounds or the like are formed along the grain boundaries, etc., and selective corrosion may occur along the grain boundaries.

Besides the above-mentioned liquid quenching process, the material of the present invention can be also prepared by other known rapid quenching processes, such as in-rotating-water melt-spinning, rotating electrode process, sputter coating, ion plating, gas atomizing, etc. Particularly, thin-film forming processes, such as sputter-coating, which produce the quenching effect as set forth above, are suitable when the sacrificial electrodes are to be applied in the form of thin films onto articles to be protected from corrosion.

Further, when the materials of the present invention are obtained in the form of thin ribbons, flat particles or spherical particles, they can be formed into bulk shapes by hot pressing, extrusion or similar consolidating processes. In any case of these forms, the materials of the present invention are applicable to sacrificial electrodes for corrosion protection. Further, the materials are also useful as coating materials in the form of particles.

When the materials are obtained in a fine wire form, they are suitable for corrosion-preventing sacrificial anodes to be used on inner faces of tubes with a small diameter or other concave inner faces. In addition, since the materials of the present invention have a superior self-corrosion resistance, they can be not only used as sacrificial electrode materials but also used alone as corrosion-resistant materials.

Example

A molten alloy 3 having a predetermined composition was prepared using a high-frequency melting furnace and charged into a quartz tube 1 having a nozzle 5 with a diameter of 0.5 mm at its lower end, as shown in the drawing. After being heated to melt the alloy 3, the quartz tube 1 was disposed right above a copper roll 2. The molten alloy 3 contained in the quartz tube 1 was ejected from the nozzle 5 of the quartz tube 1 under an argon gas pressure of 0.7 kgf/cm$^2$ and brought to collide against a surface of the copper roll 2 rapidly rotating at a rate of 4000 rpm whereby the molten alloy 3 was rapidly quenched and solidified into an alloy thin ribbon 4.

According to the processing conditions as set forth above, there were obtained alloy thin ribbons (width: 1 mm and thickness: 20 μm) having the compositions (by atomic %) as shown in Table 1. Measurements of spontaneous electrode potential, corrosion resistance and X-ray diffraction were carried out on each test specimen of the resulting alloy thin ribbons. The test results are shown in the right columns of Table 1.

The spontaneous electrode potential was measured in an aqueous solution of NaCl (NaCl: 30 g/l) at 30° C., using a saturated calomel electrode as a reference electrode.

Similarly, the corrosion resistance measurements were conducted by immersing each test specimen in the NaCl aqueous solution containing NaCl in an amount of 30 g/l at 30° C. and the quantity of hydrogen evolved due to the dissolution of the test specimen was measured. The dissolution quantity of each alloy test specimen due to corrosion was calculated from the quantity of hydrogen. The dissolution quantity was expressed in terms of a corrosion rate per year (mm/year).

In the X-ray diffraction measurements, each test specimen was adhered onto a glass plate in such a manner that the area of the adhered test specimen was about 1 $cm^2$ and an X-ray diffraction pattern was obtained using an ordinary X-ray diffractometer. Whether the alloy thin ribbons were amorphous or crystalline was confirmed from the X-ray measurement results.

The mark "<" used in the corrosion rates in Table 1 means "less than". For example, the corrosion rate of specimen No. 6 means less than 0.2 mm/year. The symbols "amo" and "amo+cry" shown in the table represent "a single phase amorphous structure" and "a composite structure consisting of an amorphous phase and a crystalline phase" respectively

TABLE 1

| Specimen No. | Composition* | Structure | Spontaneous electrode potential mV | Corrosion rate mm/year |
|---|---|---|---|---|
| 1 | $Mg_{90}Zn_{10}$ | amo + cry | −1580 | 1.20 |
| 2 | $Mg_{80}Zn_{20}$ | amo | −1490 | 1.70 |
| 3 | $Mg_{80}Zn_{10}Mm_{10}$ | amo | −1400 | 7.5 |
| 4 | $Mg_{80}Zn_{15}Mm_5$ | amo | −1470 | 2.23 |
| 5 | $Mg_{75}Zn_{15}Mm_{10}$ | amo | −1420 | 1.55 |
| 6 | $Mg_{75}Zn_{20}Mm_5$ | amo | −1350 | <0.2 |
| 7 | $Mg_{70}Zn_{20}Mm_{10}$ | amo | −1260 | <0.1 |
| 8 | $Mg_{80}Al_5Y_{15}$ | amo | −1510 | 2.96 |
| 9 | $Mg_{70}Al_5Zn_5Y_{20}$ | amo | −1520 | 1.2 |
| 10 | $Mg_{85}Al_5Ca_9Zn_1$ | amo | −1600 | 1.61 |
| 11 | $Mg_{75}Al_5Ca_5Zn_{15}$ | amo | −1570 | 1.3 |
| 12 | $Mg_{85}Zn_{12}La_3$ | amo + cry | −1550 | 3.7 |
| 13 | $Mg_{75}Zn_{20}La_5$ | amo | −1470 | 0.9 |
| 14 | $Mg_{85}Zn_{10}Nd_5$ | amo + cry | −1470 | 6.3 |
| 15 | $Mg_{80}Ga_{15}Ce_5$ | amo + cry | −1510 | 2.7 |
| 16 | $Mg_{79}Ga_{17}Ce_4$ | amo + cry | −1510 | 4.3 |
| 17 | $Mg_{85}Zn_{10}Mm_5$ | amo + cry | −1520 | 9.6 |
| 18 | $Mg_{60}Zn_{30}Mm_{10}$ | amo + cry | −1230 | <0.2 |
| 19 | $Mg_{65}Zn_{30}Mm_5$ | amo | −1240 | <0.1 |
| 20 | $Mg_{75}Zn_{20}Ce_5$ | amo | −1470 | <0.2 |
| 21 | $Mg_{85}Zn_{12}Ce_3$ | amo + cry | −1520 | 2.2 |
| 22 | $Mg_{85}Zn_{10}In_5$ | amo + cry | −1560 | 1.5 |
| 23 | Mg(99.9) | — | −1650 | 1.53 |
| | (Reference specimen) | | | |

*Fe contents are as follows:

| Specimen No. | Fe content (ppm) |
|---|---|
| 3 | 1400 |
| 4 | 770 |
| 5 | 1330 |
| 6 | 730 |
| 7 | 1270 |
| 18 | 800 |
| 19 | 1160 |
| 20 | 660 |

It has been found that all the test thin ribbons have spontaneous electrode potentials of not more than −1200 mV and are suitable as sacrificial electrode materials in a wide range of applications. Further, it has also been found that all the test thin ribbons have self-corrosion rates of not more than 9.6 mm/year and have properties desirable for use in sacrificial electrodes.

As a further noticeable advantage, although specimens Nos. 3 to 7 and 18 to 20 contained iron in amounts of about 0.1 atomic %, their self-corrosion resistance was very superior. This shows that the materials of the present invention allow a wide content range of transition metal elements.

As described above, the materials of the present invention are not only suitable as sacrificial electrode materials for the purpose of corrosion prevention, but also are useful as corrosion-resistant light-weight alloy materials.

Further, since a very wide content range of impurities comprising transition metal elements is allowable in the present invention, severe limitations imposed on conventional sacrificial electrode materials, which require the use of highly pure raw metallic materials, can be relieved.

We claim:

1. A sacrificial electrode material for corrosion prevention which consists of a structure consisting of an amorphous phase, the sacrificial electrode material being prepared as thin films, thin ribbons, fine wires or particles or in bulk shapes, by rapidly quenching a magnesium-based alloy material from a liquid phase or vapor phase thereof, the magnesium-based alloy material consisting of a composition represented by the general formula:

$$Mg_{bal}X1_aX2_b \text{ or } Mg_{bal}X1_a,$$

wherein:

X1 is at least one element selected from the group consisting of Al, Ga, Ca and In;

X2 is at least one element selected from the group consisting of misch metal, Y and rare earth metal elements;

a and b are, in atomic percentages:

$$5.0 \leqq a \leqq 35.0 \text{ and } 3.0 \leqq b \leqq 25.0,$$

respectively, with one or more transition metal elements in tolerable contents not exceeding 1.0 atomic % in their total.

2. The sacrificial electrode material of claim 1, wherein said material has a spontaneous electrode potential of not more than −1200 mV and a self-corrosion rate of not more than 9.6 mm/year.

3. The sacrificial electrode material of claim 1, wherein said one or more transition metal elements are present in an amount exceeding 30 ppm but not greater than 1.0 atomic %.

4. A sacrificial electrode material for corrosion prevention which consists of a structure consisting of an amorphous phase and a crystalline solid solution phase, the sacrificial electrode material being prepared as thin films, thin ribbons, fine wires or particles or in bulk shapes, by rapidly quenching a magnesium-based alloy material from a liquid phase or vapor phase thereof, the magnesium-based alloy material consisting of a composition represented by the general formula:

$$Mg_{bal}X1_aX2_b \text{ or } Mg_{bal}X1_a,$$

wherein:

X1 is at least one element selected from the group consisting of Al, Ga, Ca and In;

X2 is at least one element selected from the group consisting of misch metal, Y and rare earth metal elements;

a and b are, in atomic percentages:

$5.0 \leqq a \leqq 35.0$ and $3.0 \leqq b \leqq 25.0$, respectively, with one or more transition metal elements in tolerable contents not exceeding 1.0 atomic % in their total.

5. The sacrificial electrode material of claim 4, wherein said material has a spontaneous electrode potential of not more than −1200 mV and a self-corrosion rate of not more than 9.6 mm/year.

6. The sacrificial electrode material of claim 4, wherein said one or more transition metal elements are present in an amount exceeding 30 ppm but not greater than 1.0 atomic %.

* * * * *

UNITED STATES PATENT AND TRADEMARK OFFICE

CERTIFICATE OF CORRECTION

PATENT NO. : 5 423 969

DATED : June 13, 1995

INVENTOR(S) : Tsuyoshi MASUMOTO, et al.

It is certified that error appears in the above-indentified patent and that said Letters Patent is hereby corrected as shown below:

On the title page, item [73] add as assignee;

Tsuyoshi MASUMOTO, Miyagi, Japan

Signed and Sealed this

Twenty-fourth Day of September, 1996

*Attest:*

Bruce Lehman

BRUCE LEHMAN

*Attesting Officer*

*Commissioner of Patents and Trademarks*